United States Patent [19]

Katabe et al.

[11] Patent Number: 4,515,852

[45] Date of Patent: May 7, 1985

[54] LEATHER-LIKE SHEET MATERIAL HAVING LOW SLIP CHARACTERISTICS

[75] Inventors: Kenichi Katabe, Wakayama; Takeo Nishimura, Okayama, both of Japan

[73] Assignees: Kuraray Co., Ltd., Okayama; Kao Soap Co., Ltd., Tokyo, Japan

[21] Appl. No.: 492,451

[22] Filed: May 6, 1983

[30] Foreign Application Priority Data

May 10, 1982 [JP] Japan ..... 57-78877

[51] Int. Cl.[3] ..... B32B 7/00; B32B 15/00; D03D 3/00

[52] U.S. Cl. ..... 428/246; 428/245; 428/284; 428/286; 428/262; 428/904; 428/423.3; 524/507; 524/591

[58] Field of Search ..... 428/423.3, 904, 246, 428/286, 284, 245, 260, 262, 264, 265, 267; 528/45; 524/507, 591

[56] References Cited

U.S. PATENT DOCUMENTS 3,503,935 3/1970 Ziemann et al. ..... 528/371
3,984,607 10/1976 Thoma et al. ..... 428/904
4,233,359 11/1980 Mimura et al. ..... 428/904

FOREIGN PATENT DOCUMENTS 19901 3/1975 Japan ..... 428/423.3
43480 3/1981 Japan ..... 428/423.3
2026903 2/1980 United Kingdom ..... 428/904

*Primary Examiner*—George F. Lesmes
*Assistant Examiner*—Beverly K. Johnson
*Attorney, Agent, or Firm*—Wegner & Bretschneider

[57] ABSTRACT

A leather-like sheet material having low slip characteristics comprising:

a sheet material having a fibrous substrate and a surface layer consisting of a polymer mainly composed of polyurethane elastomer, and an acryl-modified polyurethane resin spread on the said surface, whereby the sheet material has a remarkably high friction coefficient, and is adapted to balls, baseball gloves, bags, cases and the like which are required to prevent slipperiness.

8 Claims, No Drawings

LEATHER-LIKE SHEET MATERIAL HAVING LOW SLIP CHARACTERISTICS

The present invention relates to a leather-like sheet material of which slipperiness on the surface is decreased. More particularly, the present invention relates to a leather-like sheet material which comprises a leather-like sheet material having a fibrous substrate layer, a surface layer consisting of a polymer mainly composed of polyurethane elastomer, and a layer of an acryl-modified polyurethane resin spread on said surface layer, and whereby the surface of the leather-like sheet material has a slip resistance.

Leather-like sheet materials comprising a substrate composed of a fibrous mat (e.g. a mat made of non-woven fabric, woven fabric, knitted fabric) or a sheet material obtained by impregnating the said fibrous mat with an elastic polymer (e.g. polyurethane), and a porous and/or nonporous surface layer consisting of a polymer mainly composed of polyurethane elastomer formed on the said substrate have been so far used widely as a substitute of a natural leather, because their appearance, feel and the like are similar to those of a natural leather.

One application of a natural leather is sports goods such as large-sized balls (e.g. volleyball, association football and rugby football) and baseball gloves, and the leather-like sheet materials are also used in such utilities.

However, the surface of such known leather-like sheet materials has a property of more slippery as compared with natural leathers, and hence, the said property has barred the leather-like sheet material from development thereof in utilities above-mentioned. For example, when leather-like sheet materials are made up into a ball, the resulting ball has a defect that it is difficult to catch or pass, or when materials are made up into a glove, the resulting glore has a defect that gripped ball in the glove tends to fall. When such leather-like sheet materials are made up into camera case, the resulting case also has a property of slippery from hands, and breaks down an expensive camera.

Many attempts have been made to decrease slipperiness on the surface of the known leather-like sheet materials.

For example, one method comprises embossing large concave and convex emboss pattern onto the surface of leather-like sheet materials to decrease slipperiness, and another method comprises spreading with gum rosin on the surface. However, in the former method, an emboss pattern having remarkable height difference between concave and convex has to be embossed to exert sufficient effect, and the leather-like sheet-materials which are given such particular emboss pattern have a defect that it is used only in remarkable narrow limited applications because of its particular concave and convex pattern on the surface. In the latter method, there can be obtained an effect to some degree in view of decreasing slipperiness on the surface temporally, but the method has a fatal defect that it cannot decrease slipperiness on the surface semi-permanently. Thus, the known methods are never sufficient to decrease slipperiness on the surface.

It is also known that for increasing hardness of the surface of leather-like sheet materials in order to give wearing characteristics thereto, acrylic resins such as polymethyl methacrylate or its mixture composition with polyurethane elastomer are spread on the surface of leather-like sheet materials. However, such a method cannot accomplish the object, that is the method never decrease the slipperiness of the surface.

The present inventors have intensively studied an improved method for obtaining a leather-like sheet material having excellent slip resistance. As a result, it has been found that an acryl-modified polyurethane resin is effective, that is, when such a resin is spread on the surface of a leather-like sheet material, there can be obtained a leather-like sheet material having excellent slip resistance.

An object of the present invention is to provide an improved leather-like sheet material having decreased slipperiness on the surface semi-permanently. Another object of the present invention is to provide an improved leather-like sheet material of which surface figure and internal structure are not almost changed by treatment for decreasing slipperiness on the surface, and hence, which can be used for various applications. These and other objects and advantages of the invention will be apparent to those skilled in the art from the following description.

These objects are accomplished by giving an acryl-modified polyurethane resin on the surface of a leather-like sheet material which comprises a fibrous substrate and a surface layer consisting of a polymer mainly composed of polyurethane elastomer.

The fibrous substrate which constitutes the leather-like sheet material of the present invention, comprises a fibrous mat or a combination of fibrous mat and elastic polymer impregnated thereinto.

The fibrous mat is made of a material in the form of non-woven fabric, woven fabric and knitted fabric. Preferred material is a non-woven fabric which is made by entanglment of fiber web by means of needle punching method, fluid jetting method and the like, because it has feel similar to that of a natural leather.

Suitable examples of the fiber employed for the fibrous mat are natural fibers, such as cotton, flax, wool and the like, regenerated or semisynthetic fibers such as rayon, acetate and the like, and synthetic fiber such as nylon, polyester, polyacrylonitrile, vinylon, polyolefin and the like. As the synthetic fiber, there can be used not only single spun fiber, but also mixed spun fiber (including conjugated spun fiber). In case of mixed spun fiber, it is preferable to convert the fiber into fine-denier bundle fiber or oriented-multi-hole fiber having many internal holes, which can be prepared by extracting away at least one polymer component in the fiber composed of two or more polymers or by dividing the conjugated spun fiber into each polymer which composes the fiber in an appropriate step during the steps of manufacturing the leather-like sheet. Such method can make the fibrous substrate limp, and hence, the leather-like sheet material having such as substrate becomes limp and has a feel of high-grade goods.

Examples of such methods include a process for extracting polystyrene away from mixed spun fiber consisting of nylon and polystyrene, or polypropylene and polystyrene with toluene, a process for extracting polyethylene away from mixed spun fiber consisting of polyethylene terephtalate and polyethylene or nylon and polyethylene with toluene, a process for extracting nylon away from mixed spun fiber consisting of polyethylene terephtalate and nylon with benzyl alcohol or methanol including calcium chloride, and the like.

Fineness of fiber constituting a fibrous substrate is preferably 0.0005 to 10 denier, most suitably 0.001 to 2.0 denier. The fiber is not required uniform fineness, and fiber having different fineness can be mixed.

Into the fibrous substrate, an elastic polymer may be impregnated. All of the elastic polymer commonly employed in synthetic leather or artificial leather can be used as an elastic polymer impregnated into the fibrous substrate in the present invention. Examples of the elastic polymer are natural rubbers, styrene-butadiene copolymers, acrylonitrile-butadiene copolymers, methylmethacrylate-budatiene copolymers, polyvinyl chloride, polyurethane, other synthetic rubbers and the mixture thereof. These elastic polymers may be impregnated into the fibrous substrate in the form of an emulsion or solution. In order to give feel similar to natural leather by decreasing resiliency of fibrous substrate moderately, the elastic polymer included in the fibrous substrate is preferably in porous form.

The typical method for making an elastic polymer porous is, for example, to impregnate a solution of elastic polymer into the fibrous mat, and then to subject it to wet coagulation, that is the fibrous mat is dipped into a liquid which has affinity to a solvent, but does not have affinity to the polymer to coagulate the polymer.

The amount of the elastic polymer impregnated is usually in the range of less than 250% by weight, preferably 30 to 200% by weight, based on the weight of the fibrous mat.

The above fibrous substrate has preferably a thickness of 0.3 to 5 mm and a density of 0.2 to 0.8 g/cm$^3$.

In the present invention, the surface layer consisting of a polymer mainly composed of polyurethane elastomer is formed on either or both side of the fibrous substate.

The surface layer, which corresponds to grain layer of natural leather, is preferably a multi-layer construction which comprises a porous layer consisting of a polymer mainly composed of polyurethane elastomer and a nonporous layer consisting of a polymer mainly composed of polyurethane disposed on said porous layer, in view of good feel, wrinkle of crease, properties and the like.

The polymer mainly composed of polyurethane consisting the surface layer includes polyurethane elastomer alone and the mixture with other polymers.

The typical example of the polyurethane elastomer employed in the invention is so-called segmented polyurethane, that consists of soft segments and hard segments, which is obtained by polymerizing mainly one or more polymeric diols such as polyesterdiol, polyetherdiol, polyester-etherdiol and the like, one or more organic polyisocyanates, preferably an aromatic or aliphatic diisocyanate, and a chain extender having two active hydrogen atoms such as low molecular weight diol, low moleculer weight diamine, hydrazine and the like. Preferred polyurethane elastomer is a polyurethane elastomer, wherein the amount of nitrogen (referred to as N %) in isocyanate group of the organic polyisocyanate employed to prepare the polyurethane elastomer is 3 to 7% by weight based on the total weight of polyurethane elastomer. When N % is not more than 3%, the resulting surface layer is inferior in wearing characteristics and scratch resistance. When N % is over 7%, the resulting surface layer make rough crease, and the resulting leather-like sheet material looks cheap as well as is inferior in flexural fatigue resistance.

Suitable examples of the polymer employed with the above polyurethane elastomer are polyvinyl chloride, natural and synthetic rubbers, polyvinyl acetate, cellulose derivatives, polyacrylonitrile and the like.

To the surface layer may be added, if desired, fillers, flexbilizers, stabilizers, colorants, antistatic agents and the like. In particular, the fibrous substrate has unevenness of concave and convex or uneven color due to fiber, and hence, colorants such as pigments, dyes and the like are preferably added to the surface layer to cover such unevenness.

The polymer mainly composed of polyurethane elastomer has preferably a Young's modulus of 1.0 to 20 kg/mm$^2$.

The Young's modulus herein is determined as follows: The polymer is formed into a dry film (100$\mu\times$15 mm). The resulting film (sample) is held to a tensile tester at the chuck-distance of 50 mm, and pulled at the rate of 200 mm/min. A tangent line (straight line) is drawn in contact with the initial rising part of stress (kg) -elongation (%) curve, from which a stress (kg) corresponding to 100% elongation is determined. The stress (kg) divided by sectional area (mm$^2$) of the sample gives the Young's modulus. When the Young's modulus is not more than 1.0 kg/mm$^2$, the polymer is too soft and a surface strength is not sufficient, and the resulting leather-like sheet material prepared therefrom is rubber-like and does not have natural leather-like feel. On the other hand, when the Young's modulus is over 20 kg/mm$^2$, the resulting leather-like sheet material is inferior in flexural fatigue resistance and does not show natural leather-like crease.

When the surface layer in the leather-like materials of the present invention is a porous layer, the thickness of said layer is preferably in the range of 10 to 1000$\mu$. When the surface layer is a nonporous layer, the thickness is preferably in the range of 1 to 100 $\mu$. When the surface layer consists of a porous layer and a nonporous layer, the porous layer has preferably a thickness of 50 to 800$\mu$ and the nonporous layer has preferably a thickness of 1 to 20$\mu$. The nonporous layer may have multilayer construction, for example, it may consist of a laminate of a nonporous layer containing a pigment and a nonporous layer containing a dye. When the nonporous layer has multi-layer construction, the total thickness of the nonporous layer is also preferably in the above range.

When the thickness of the porous layer is over the above range, the resulting leather-like sheet material has rubber-like feel. When the thickness of the nonporous layer is over the above range, the resulting leather-like sheet material has hard feel and bad crease, and is inferior in flexural fatigue resistance. On the other hand, when the thickness of the surface layer is less than the above range, the undesirable unevenness of concave and convex or color, of the fibrous substrate can not sufficiently be eliminated, and hence, the resulting leather-like sheet material give an impression of a cheap product.

The surface layer is formed by spreading a solution of a polymer mainly composed of polyurethane elastomer on a fibrous mat directly, and subjecting the resulting surface layer to dry or wet coagulation, or by spreading a solution or emulsion of a polymer mainly composed of polyurethane elastomer on the surface of other base plate such as a polymer sheet, a metal belt, or a glass plate, subjecting them to dry or wet coagulation to give a film, and laminating the film thus obtaihed onto a fibrous mat.

The porous layer is generally formed by subjecting a solution of a polymer mainly composed of polyurethane elastomer to wet coagulation, and the nonporous layer is generally formed by dry coagulation method, mainly by only evaporating to remove a solvent or di-persing medium from a spread polymer solution or emulsion.

The leather-like sheet material is covered by an acryl modified polyurethane resin onto outermost surface thereof to decrease slipperiness as mentioned above.

The acryl-modified polyurethane resins employed in the invention can be obtained by polymerization of a polymerizable unsaturated compound in the presence of a polyurethane emulsion.

The polyurethane emulsion includes not only aqueous emulsion but also aqueous dispersion and aqueous solution of a polyurethane, but is preferably an aqueous emulsion. For example, the polyurethane emulsion can be obtained by polymerizing one or more polyols such as polyesterpolyols, polyetherpolyols, polyesterpolyetherpolyols and the like, and one or more organic polyisocyanates, optionally in the presence of chain extenders having two or more active hydrogen atoms such as low molecular weight polyols, low molecular weight polyamines, and further known modifiers. The resin constituting the polyurethane emulsion is preferably a thermosetting resin in order to accomplish the object of the present invention. The polyurethane emulsions usable in the present invention are well known, and are discussed, for example, in Japanese Patent Publication Nos. 16760/1968, 17595/1968, 34158/1970 etc. or in other literatures.

The polymerizable unsaturated compounds employed in the present invention are organic compounds having one or more radically addition-reactive double bonds and from 2 to 20 carbon atoms. Suitable examples of such unsaturated compounds are unsaturated carboxylic acids (e.g. acrylic acid, methacrylic acid, maleic acid, fumaric acid, itaconic acid, crotonic acid etc.), esters thereof with an alkyl or substituted alkyl, amides or substituted amides thereof, metal salts or amine salts thereof; vinyl esters of fatty acid or substituted fatty acid; unsaturated compounds having a substituent selected from a halogen, amino, methylol, nitrile, aromatic group and the like; diene compounds (e.g. butadiene, chloroprene, isoprene, etc.), which may be used alone or in combination of two or more thereof.

It is preferable to use the polyurethane/polymerizable unsaturated compound, which constitute the acryl-modified polyurethane resin, in the ratio of 0.5/99.5 to 98/2 by weight.

The acryl-modified polyurethane resin itself is known. For example, Japanese patent publication (unexamined) No. 61784/1982 discloses the resin, and teaches that the resin is useful as an agent for increasing color fastness of fibers, that is to say, the resin increases color fastness by spreading the resin on the surface of fiber before or after dyeing operation or in dyeing operation. Moreover, the above literature discloses the process for preparing such a resin in detail. However, the above literature never discloses that such a resin can be spread on the surface of a leather-like sheet material, and that the material of which surface is covered by such a resin has higher surface friction coefficient and become less slippery.

The leather-like sheet material of the present invention is spread with the resin obtained above. The acryl-modified polyurethane resin is spread usually in an amount of 0.1 to 20 g/m$^2$ based on the solids content. Conventional methods for spreading can be employed in the present invention, but it is most preferably to spread an aqueous emulsion of said resin on the surface of sheet material by spraying or gravure printing, and then drying the resulting surface. The leather-like sheet material does not require the surface covered uniformly by acryl-modified polyurethane resin, in other words, the leather-like sheet material may have fine spots, stripe and the like on its surface.

Then, the leather-like sheet material spread with the emulsion of said resin is dried. In the drying operation, when the polyurethane emulsion has thermosetting property, the polyurethane is cured by cross-linking reaction, and exhibits improved scratch resistance, wearing characteristics, water resistance and the like.

The drying operation is usually carried out at a temperature of 80 to 150° C.

The leather-like sheet material of the present invention of which surface is spread with acryl-modified polyurethane does not practically taken scraping away or falling off of the surface resin by considerable violent wearing and impact, and hence, the material can also maintain low slip characteristics, on the surface semi-permanently when it is used in the application such as ball and baseball glove and the like, which is suffered violent wearing and impact.

The leather-like sheet material may be further subjected to various finishing operations such as crumpling treatment, embossed finishing and the like in manufacturing process.

Practical embodiments of the manufacturing the leather-like sheet material according to the invention are illustratively shown in the following examples wherein parts and % are by weight.

EXAMPLE 1

A needle punching non-woven fabric consisting of polyester fiber (2 denier) is impregnated with a solution of the polymer composed of polyurethane elastomer (16%, N %: 4.2%), which is obtained from polyethyleneadipate glycol, ethylene glycol and diphenylmethane-4,4'-diisocyanate, stearyl alcohol (0.5%), titanium oxide (0.5%) and dimethylformadide (83%). The amount of the polymer solution impregnated into the non-woven fabric is 60% based on the solids content. The resulting non-woven fabric is further spread with the said polymer solution in an amount of 160 g/m$^2$ based on the solids content, and dipped into an aqueous dimethylformamide coagulation bath (50° C.) containing 30% of dimethylformamide for 30 minutes. Then, the resulting material is treated with methanol for 30 minutes, washed with water and dried.

Further, on the resulting material are spread an ink consisting of the said polyurethane elastomer (8%), titanium oxide (10%), dimethylformamide (20%), cyclohexanone (35%) and acetone (27%), and an ink consisting of the said polyurethane elastomer (10%), yellowing resistant agent (0.5%), dimethylformamide (20%), cyclohexanone (39%) and acetone (30.5%) in an amount of 6 g/m$^2$ and 2 g/m$^2$ based on the solid content respectively, and the material is dried and embossed with kid pattern by embossing roll to give a leather-like sheet material. The material has a substrate thickness of 1.5 mm and a density of 0.51 g/cm$^3$, and the surface layer of the material has 450$\mu$ of porous layer and 8$\mu$ of non-porous layer. The polyurethane elastomer composed of the surface layer has a Young's modulus of 4.6 kg/mm$^2$. The sheet material is divided into three pieces, and one piece is left as it is (leather-like sheet material [A]). On the other piece is spread a dispersion consisting of acryl-modified polyurethane resin (30%), which is obtained by emulsion polymerization of ethylmethacrylate (100 parts) in an ion-exchanged water (220 parts) in the presence of a thermosetting cationic polyurethane emulsion (37.5 parts), and water (70%), in an amount of 4 g/m$^2$ based on the solids content. The resulting piece is dried at 140° C. for 2 minutes to give a leather-like sheet material [B]. The material [B] is not different from material [A] in appearance and physical properties. On another piece is spread a solution of gum rosin in an amount of 4 g/m$^2$ based on the solids content, and the resulting piece is dried to give a leather-like sheet material [C]. The material [C] is glossier than the leather-like sheet material [A], and in view of physical properties, strength on surface is decreased. The friction coefficients of the said three leather-like sheet materials [A], [B] and [C] to soft-steel (wearing surface: 65 mm×60 mm, weight: 1210 g, rate of stretch: 200 mm/minute) are 0.29, 0.76 and 0.38 respectively. The leather-like sheet material [B] of the present invention has remarkable excellent low slip characteristics.

Three volleyballs were made of the above three leather-like sheet materials [A] , [B] and [C] respectively, and used in a game. The ball of material [A] was often slippery from hands and could not be passed as desired, and hence, made much trouble in a game. While, ball of material [B] was not practically slippery from hands in a game and could be passed as desired, and the effect of slip resistance was maintained after one week use. The ball of material [C] had unpleasant oily tough, and had little effect of slip resistance, but it was not quite sufficient.

EXAMPLE 2

In the same manner as described in the leather-like sheet material [B] of Example 1, except that acryl-modified polyurethanes are spread in an amount of Table 1, leather-like sheet materials [D], [E] and [F] are prepared. The properties of the resulting leather-like sheet materials are shown in Table 1.

TABLE 1

| Sample | Amount of spreading (g/m$^2$) | Appearance | Strength on surface | Friction coefficient on surface | Test in practical use |
|---|---|---|---|---|---|
| leather-like sheet material [D] | 1.0 | good | good | 0.51 | not slippery |
| leather-like sheet material [E] | 14.0 | good | good | 0.88 | not slippery |
| leather-like sheet material [F] | 26.0 | gloss unevenness on surface | good | 0.89 | not slippery, but some hard on surface |

EXAMPLE 3

In the same manner as described in leather-like sheet material [B] of Example 1, except that an acryl-modified polyurethane resin which is obtained by emulsion polymerization of ethyl acrylate (100 parts) in an ion-exchanged water (220 parts) in the presence of a thermosetting cationic polyurethane emulsion (37.5 parts) is used, leather-like sheet material [G] is prepared.

While the acryl-modified polyurethane resin, which is obtained by emulsion polymerization of butyl acrylate (95 parts) and glycidyl methacrylate (5 parts) in an ion-exchanged water (220 parts) in the presence of a thermosetting cathionic polyurethane emulsion, is spread on the leather-like sheet material [A] in the same manner as described in the case of leather-like sheet material [B] to give a leather-like sheet material [H].

On the other hand, a solution of a resin consisting of a polyurethane (9%), which is obtained from polybutyleneadipate glycol, diphenylmethane-4,4'-diisocyanate and ethylene glycol, and poly(methylmethacrylate) (3%), dimethylformamide (22%), methylethyl ketone (36%) and cyclohexanone (30%), is spread instead of the acryl-modified polyurethane resin on the surface of leather-like sheet material [A] in an amount of 4 g/m$^2$ based on the solids content. The resulting material is dried to give a leather-like sheet material [I]. The properties of these resulting leather-like sheet materials are shown in Table 2.

TABLE 2

| Sample | Amount of spreading (g/m$^2$) | Appearance | Strength on surface | Friction coefficient on surface | Test in practical use |
|---|---|---|---|---|---|
| leather-like sheet material [G] | 4.0 | good | good | 0.72 | not slippery |
| leather-like sheet material [H] | 4.0 | good | good | 0.78 | not slippery |
| leather-like sheet material [I] | 4.0 | not gloss on surface, bad | good | 0.20 | remarkably slippery on surface, remarkably unsuited for ball |

EXAMPLE 4

A needle punching non-woven fabric, is impregnated with a solution of the polymer composed of polyurethane elastomer (11%, N%: 5%), which is obtained from polytetraethylenether glycol, 1,4-butanediol and diphenylmethane-4,4'-diisocyanate, polyvinyl chloride (1%), sodium dioctylsulfosuccinate (2.5%), a brown inorganic pigment (0.5%) and dimethylformamide (85%). The polymer solution is impregnated into the non-woven fabric in an amount of 45% based on the solids content.

The resulting non-woven fabric is dipped into an aqueous dimethylformamide coagulation bath (35° C.) containing 45% of dimethylformamide for 30 minutes to be subjected to coagulation, and then washed with water and dried.

Further, on the surface of the resulting material are spread an ink consisting of polyurethane elastomer (10%), which is obtained from polycaprolactone glycol, dicyclohexylmethane-4,4'-diisocyanate and 1-amino-3-aminomethyl-3,5,5-trimethylcyclohexane (isophoronediamine), a brown pigment (3%), dimethylformamide (24%), methanol (28%), toluene (8%), isopropanol (5%), acetone (12%) and cyclohexanone (10%) in an amount of 16 g/m$^2$ based on the solids content, and the resulting material is embossed with sheepskin pattern. Then, on the resulting material is spread a dispersion solution consisting of an acryl-modified polyurethane resin (20 parts), which is obtained by emulsion polymerization of isobutyl methacrylate (20 parts) in an ion-exchanged water (30 parts) in the presence of a thermosetting anionic polyurethane emulsion (50 parts), and water (80 parts) in an amount of 8 g/m$^2$ based on the solids content. The material is dried to give a leather-like sheet material [J]. The substrate of the leather-like sheet has a thickness of 1.8 mm and a density of 0.41 g/cm$^3$, and the surface layer is a nonporous layer with a thickness of 16 . Young's modulus of the resin composed of the surface layer is 9.5 kg/mm$^2$.

The color and gloss of the resulting leather-like sheet material are both excellent.

The glove made of the resulting material had a remarkable slip resistance, and hence, could catch a ball easily. The material had long holding time of slip resistance and an excellent value as an article of commerce.

EXAMPLE 5

In the same manner as described in the leather-like sheet [J] of Example 4, except that an acryl-modified polyurethane resins are spread in an amount of Table 3, leather-like sheet materials [K] and [L] are prepared. The properties of the resulting leather-like sheet materials are shown in Table 3.

TABLE 3

| Sample | Amount of spreading (g/m$^2$) | Appearance | Strength on surface | Friction coefficient on surface | Test in practical use |
|---|---|---|---|---|---|
| leather-like sheet material [K] | 3.0 | good | good | 0.80 | not slippery |
| leather-like sheet material [L] | 14.0 | good | good | 0.93 | not slippery |

EXAMPLE 6

By means of needle punching method, the entangled non-woven fabric is made of fiber (3 denier) which is obtained from 6-nylon (50 parts) and polystyrene (50 parts) by mixed spun. The non-woven fabric has a density of 0.20 g/cm$^3$. The non-woven fabric is firstly impregnated with 3.2% of an aqueous polyvinyl alcohol solution, dried, and then impregnated with a solution of the polymer consisting of polyurethane elastomer (15%, N%: 4.2%, Young's modulus: 4.3 kg/mm$^2$), which is composed of polybutyleneadipate glycol, ethylene glycol and diphenylmethane-4,4'-diisocyanate, and dimethylformamide (85%). The resulting non-woven fabric is further spread with the above polymer solution in an amount of 100 g/m$^2$ based on solids content, and the resulting fabric is dipped into an aqueous dimethylformamide coagulation bath (50° C.) containing dimethylformamide (40%) for 30 minutes and is subjected to coagulation.

The resulting sheet material is dipped into hot-toluene (90° C.) and extract to remove polystyrene constituting of the fiber. By extracting polystyrene, the fiber is converted into oriented-multi-hole fiber having many hollow parts to become remarkably limp. The sheet material, which is extracted, is washed with water to remove dimethylformamide and polyvinyl alcohol completely, and then dried. On the surface spread with the above polymer solution of the resulting sheet material, an ink consisting of a polyurethane elastomer (8%, N%: 4.2%, Young's modulus: 4.6 kg/mm$^2$), which is composed of polyethyleneadipate glycol, ethylene glycol and diphenylmethane-4,4'-diisocyanate, titanium oxide (10%), dimethylformamide (20 cyclohexanone (35%) and acetone (27%) is further spread in an amount of 6 g/m$^2$ based on the solids content. Further, on the resulting surface is spread an ink consisting of a polyurethane elastomer (10%), which is used in the above ink, a yellowing resistant agent (0.5%), dimethylformamide (20%), cyclohexanone (39%) and acetone (30.5%) in an amount of 2 g/m$^2$ based on the solids content. After drying, the resulting material is embossed by embossing roll with kid pattern to give a leather-like sheet material. The leather-like sheet has a substrate thickness of 1.5 mm, a density of 0.47 g/cm$^3$ and a surface layer having 320$\mu$ thickness of a porous layer and 8$\mu$ thickness of a nonporous layer. The substrate containes 120% of the polyurethane elastomer based on the fiber. On the resulting leather-like sheet material, the same aqueous dispersion of an acryl-modified polyurethane resin as used in Example 1 is spread in an amount of 6 g/cm$^2$ based on the solids content and the resulting material is dried at a temperature of 140° C. for 2 minutes to give a leather-like sheet material [M]. The resulting leather-like sheet material has a friction coefficient of 0.80 and then has remarkably excellent low slip characteristics.

The leather-like sheet material has excellent appearance and strength of surface.

The volleyball made of the resulting leather-like sheet material was not practically slippery from hands, and the effect of slip resistance was practically same after one month use.

EXAMPLE 7

By means of needle punching method, the entangled non-woven fabric is made of the fiber (4 denier) which is obtained from polyethylene (50 parts) and 6-nylon (50 parts) by mixed spun. The non-woven fabric has a density of 0.30 g/cm$^3$. The non-woven fabric is impregnated with a solution of polymer consisting of the polyurethane elastomer (18%, N%: 40%, Young's modulus: 3.8 kg/mm$^2$) composed of polyethylenebutyleneadipate glycol, 1,4-buthanediol and diphenylmethane-4,4'-diisocyanate, and dimethylformamide (82%). The resulting fabric is further spread with a solution of polymer consisting of the above polyurethane elastomer (13%) and dimethylformamide (87%) in an amount of 90 g/m$^2$ based on the solids content, and then dipped into an aqueous dimethylformamide coagulation bath (40° C.) consisting 30% of dimethylformamide for 30 minutes to be subjected to wet-coagulation. The resulting sheet material is further dipped into hot-toluene (90° C.), and the polyethylene constituted of the fiber is extracted away. By extracting polyethylene, the fiber is converted into fine-denier-bundle fiber having an average thickness of 0.003 denier and the sheet material become remarkably limp. The sheet material, which is extracted, is washed with water to remove dimethylformamide completely, and dried. On the surface spread with the above polymer solution of the resulting sheet material is spread an ink consisting of the same polyurethane elastomer (7%) as used in the above impregnation and spreading, a brown inorganic pigment (3%), dimethylformamide (22%), acetone (41%) and cyclohexanone (27%) in an amount of 4 g/m$^2$ based on the solids content. Then, the resulting material is embossed by embossing roll with sheepskin pattern to give a leather-like sheet material. The resulting leather-like sheet has a substrate thickness of 2 mm, a density of 0.45 kg/cm$^3$ and the surface layer having 350$\mu$ thickness of a porous layer and 4$\mu$ thickness of a nonporous layer. The substrate contains 84% of the polyurethane elastomer based on the fiber. On the leather-like sheet material, the same acryl-modified polyurethane resin as used in sheet material [H] is spread in an amount of 8 g/cm$^2$ based on the solids content and the resulting material is dried at a temperature of 120° C. for 4 minutes to give a leather-like sheet material [N]. The resulting leather-like sheet material has a friction coefficient of 0.91, and then has remarkably excellent low slip characteristics.

The leather-like sheet material has limp feel, excellent appearance and strength of surface.

The glove made of the resulting leather-like sheet material could catch a ball quite easily, and after long time use, the effect of slip resistance did not practically change.

What is claimed is:

1. A leather-like sheet material having low slip characteristics comprising:

sheet material having a fibrous substrate consisting of a fibrous mat, a surface layer consisting of a polymer mainly composed of a polyurethane elastomer, and an acryl-modified polyurethane resin spread on the surface layer, said acryl-modified polyurethane resin spread on the surface layer, said acryl-modified polyurethane resin being made by polymerization of an ethylenically unsaturated compound in the presence of a polyurethane emulsion.

2. The leather-like sheet material according to claim 1, wherein the surface layer has a porous layer consisting of a polymer mainly composed of a polyurethane elastomer and a nonporous layer consisting of a polymer mainly composed of a polyurethane elastomer.

3. The leather-like sheet material according to claim 1, wherein the surface layer contains a colorant.

4. The leather-like sheet material according to claim 1, wherein the polyurethane elastomer constituting the surface layer has nitrogen atoms derived from isocyanate group of the organic polyisocyanate in an ambunt of 3 to 7 % by weight based on the polyurethane elastomer.

5. The leather-like sheet material according to claim 1, wherein the polymer mainly composed of a polyurethane. elastomer has a Young's modulus of 1.0 to 20 kg/mm$^2$.

6. The leather-like sheet material according to claim 1, wherein the acryl-modified polyurethane is spread in an amount of 0.1 to 20 g/m$^2$ based on the solids content.

7. The leather-like sheet material according to claim 1, wherein the fibrous mat is impregnated with an elastic polymer.

8. The leather-like sheet material according to claim 7, wherein the surface layer has a porous layer consisting of a polymer mainly composed of a polyurethane elastomer and a non-porous layer consisting of a polymer mainly composed of a polyurethane elastomer.

* * * * *